US008529275B2

(12) United States Patent
Kagotani

(10) Patent No.: US 8,529,275 B2
(45) Date of Patent: Sep. 10, 2013

(54) ASSEMBLED COMPONENT HAVING ELECTRICAL CONNECTOR AND ELECTRICAL CONNECTOR CAP, ELECTRICAL CONNECTOR CAP, AND METHOD OF MOUNTING ELECTRICAL CONNECTOR

(75) Inventor: Koichi Kagotani, Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 0 days.

(21) Appl. No.: 13/217,779

(22) Filed: Aug. 25, 2011

(65) Prior Publication Data

US 2012/0052753 A1 Mar. 1, 2012

(30) Foreign Application Priority Data

Aug. 31, 2010 (JP) ..... 2010-193319

(51) Int. Cl.
*H01R 13/60* (2006.01)

(52) U.S. Cl.
USPC ..... 439/41; 439/940

(58) Field of Classification Search
USPC ..... 439/135, 940, 148, 149, 41
See application file for complete search history.

(56) References Cited

U.S. PATENT DOCUMENTS

| | | | | |
|---|---|---|---|---|
| 4,396,245 | A * | 8/1983 | Lane | 439/148 |
| 5,026,295 | A * | 6/1991 | Fong et al. | 439/135 |
| 5,558,540 | A * | 9/1996 | Kato et al. | 439/637 |
| 5,899,760 | A * | 5/1999 | Ho et al. | 439/135 |
| 5,910,023 | A * | 6/1999 | McHugh et al. | 439/41 |
| 6,015,305 | A * | 1/2000 | McHugh et al. | 439/135 |
| 6,135,795 | A * | 10/2000 | Ho et al. | 439/135 |
| 6,168,444 | B1 * | 1/2001 | Wu et al. | 439/135 |
| 6,439,901 | B1 * | 8/2002 | Ji et al. | 439/135 |
| 6,506,064 | B1 * | 1/2003 | Wu | 439/135 |
| 6,599,140 | B1 * | 7/2003 | Chen et al. | 439/135 |
| 7,621,751 | B2 * | 11/2009 | Minich | 439/41 |
| 7,828,564 | B2 * | 11/2010 | Guan et al. | 439/135 |
| 7,946,865 | B1 * | 5/2011 | Lai | 439/135 |
| 8,052,439 | B2 * | 11/2011 | Fan et al. | 439/135 |
| 8,142,201 | B2 * | 3/2012 | Fan | 439/41 |
| 8,206,158 | B2 * | 6/2012 | Hsu et al. | 439/41 |
| 2004/0248442 | A1 * | 12/2004 | Huang | 439/135 |
| 2005/0032397 | A1 * | 2/2005 | Huang | 439/41 |
| 2005/0130472 | A1 * | 6/2005 | Hou | 439/135 |
| 2006/0094271 | A1 * | 5/2006 | Zhang et al. | 439/135 |
| 2007/0155205 | A1 * | 7/2007 | Harper | 439/135 |
| 2007/0202718 | A1 * | 8/2007 | Liao | 439/78 |
| 2008/0009158 | A1 * | 1/2008 | Ma et al. | 439/135 |
| 2008/0045048 | A1 * | 2/2008 | Ma | 439/73 |

(Continued)

FOREIGN PATENT DOCUMENTS

JP 09-153384 6/1997

*Primary Examiner* — Ross Gushi
(74) *Attorney, Agent, or Firm* — Kubotera & Associates LLC

(57) ABSTRACT

An assembled component includes a plurality of electrical connectors to be disposed on a circuit board in a specific positional arrangement; and an electrical connector cap attached to the electrical connectors for joining the electrical connectors before the electrical connectors are disposed onto the circuit board. The electrical connector cap includes a main body extending in a first direction and a second direction perpendicular to the first direction on a plane parallel to the circuit board and a first fitting section including a first reference surface. Each of the electrical connector includes a second fitting section for engaging the first fitting section. The second fitting section includes a second reference surface for contacting with the first reference surface, so that the electrical connectors are arranged in the specific positional arrangement.

8 Claims, 7 Drawing Sheets

(56) References Cited

U.S. PATENT DOCUMENTS

| | | | | |
|---|---|---|---|---|
| 2008/0102651 | A1* | 5/2008 | Szu et al. | 439/41 |
| 2008/0153330 | A1* | 6/2008 | Minich | 439/135 |
| 2009/0053915 | A1* | 2/2009 | Liao | 439/148 |
| 2009/0191736 | A1* | 7/2009 | Guan et al. | 439/135 |
| 2010/0081334 | A1* | 4/2010 | Kagotani | 439/639 |
| 2012/0052753 | A1* | 3/2012 | Kagotani | 439/892 |
| 2012/0190222 | A1* | 7/2012 | Sun | 439/135 |

* cited by examiner

ASSEMBLED COMPONENT HAVING ELECTRICAL CONNECTOR AND ELECTRICAL CONNECTOR CAP, ELECTRICAL CONNECTOR CAP, AND METHOD OF MOUNTING ELECTRICAL CONNECTOR

BACKGROUND OF THE INVENTION AND RELATED ART STATEMENT

The present invention relates to an assembled component having a plurality of electrical connectors arranged on a circuit board in a specific positional relationship with each other and an electrical connector cap that is attached to the electrical connectors before disposing on the circuit board so as to join the connectors in the specific positional relationship. The present invention also relates to an electrical connector cap and a method of mounting the electrical connector.

When a plurality of electrical connectors (also referred to as connectors) is disposed on a circuit board in a specific positional relationship with each other, the connectors may be attached to an electrical connector cap to join the connectors before disposing the connectors on the circuit board. Then, the connectors are disposed on the circuit board while the connectors are maintained in the specific positional relationship with each other. In this case, in order to securely dispose the connectors in the specific positional relationship with each other, it is necessary to securely maintain the connectors attached to the cap so as not to be displaced from regular positions thereof.

As a conventional method of joining a plurality of connectors with the electrical connector cap, two joining members as the electrical connector cap may be attached to the connectors at one ends and the other ends thereof in a longitudinal direction thereof. The joining members extend in a lateral direction and have an elongated shape. Each of the connectors has a rectangular shape, and terminals are arranged in each of the connectors in a terminal arrangement direction corresponding to the longitudinal direction of the connectors, and the lateral direction corresponds to a direction perpendicular to the longitudinal direction. Accordingly, the connectors can be disposed on the circuit board with an interval in between in the lateral direction so as to be parallel to each other.

In the conventional method, however, the two joining members are attached to two connectors at the ends thereof so as to form a link mechanism. Accordingly, the two joining members may easily move and displace relative to each other in the longitudinal direction while the two connectors are arranged in parallel to each other. When the joining members move and displace, the two connectors may also displace, thereby making it difficult to dispose the connectors on the circuit board with the specific interval in between.

Patent Reference has disclosed a conventional electrical connector cap as a separate member. According to Patent Reference, the conventional electrical connector cap is attached to two connectors having an outer shape of a rectangular prism from above. Accordingly, the two connectors are joined with the conventional electrical connector cap respectively prior before the two connectors are disposed on the circuit board.

Patent Reference: Japanese Patent Publication No. 09-153384

According to Patent Reference, the conventional electrical connector cap has two cap sections. Each of the cap sections extends in a longitudinal direction thereof and covers an upper portion of the connectors. Further, a plurality of ribs extending in the lateral direction is provided for connecting the cap sections. Therefore, whereas the conventional electrical connector cap is formed as the separate member, the conventional electrical connector cap is formed in a generally flat board, extending in the longitudinal direction and the lateral direction perpendicular to the longitudinal direction. Accordingly, a relative positional relationship of the two caps is secured with the ribs so as not to change.

According to Patent Reference, the rib located at the two ends of the connectors in the longitudinal direction has an aligning plate. The aligning plate extends downward from the rib at a center position in the lateral direction of the connector, i.e., at a position between the two connectors. The aligning plate has a plate surface vertical to the longitudinal direction. The aligning plate further has end surfaces at both ends thereof in the width direction, i.e., the lateral direction, and the end surfaces abut sidewalls of the two connectors, so that the connectors are arranged with a specified distance from each other.

In addition to the aligning plate, the two cap sections has a plurality of elastic engaging pieces that extend downward from the sidewalls, which are away from each other in the lateral direction. Each of the elastic engaging pieces abuts against the sidewall of the connector in the lateral direction to press the sidewall in the direction when the conventional electrical connector cap is attached to the connector.

Therefore, the elastic engaging pieces restrict the connectors from moving away from the aligning plates, so that the sidewall surfaces of the connectors, which face each other, tightly abut against the side end surface of the positioning plate. In addition, the cap section has a groove section, which is opened downward and extends in the longitudinal direction (the terminal arrangement direction), so as to accommodate an upper-side portion of a housing of the connector and contact sections of the terminals protruding from a side surface of the upper-side portion.

According to Patent Reference, the conventional electrical connector cap is provided with the aligning plate and the elastic engaging pieces, so that the connectors are positioned in the lateral direction. The elastic engaging pieces, however, are formed to be elastically displaceable in the lateral direction. Accordingly, when the elastic engaging pieces move elastically, it is difficult to apply a sufficient restricting force to the connectors, so that the connectors may come off from the regular position in the lateral direction.

In addition, according to Patent Reference, the cap sections include the grooves for accommodating the upper portion of the connector and the contact sections of the terminals. However, Patent Reference does not mention whether the inner wall surfaces of the groove section restrict the connectors from moving in the lateral direction. The inner surfaces of the grooves abut against the contact sections of the terminals protruding from the side surfaces of the upper portion. Accordingly, even if the inner wall surfaces of the groove section restrict the connectors, the connector may displace in the lateral direction when the contact sections of the terminals elastically displace similar to the elastic engaging pieces.

Moreover, Patent Reference does not mention how the connectors are positioned in the longitudinal direction, and there is a possibility that the movement of the connectors in the direction may not be restricted.

Therefore, according to Patent Reference, the conventional electrical connector cap may not be capable of effectively restricting the connectors from moving in each direction. Accordingly, the connectors may be inaccurately positioned, so that the connectors are arranged away from the correct regular positions before the connectors are disposed onto the circuit board. As a result, the connectors disposed on the circuit board may become off-positioned from the regular positions, and it is difficult to dispose the connectors in the specific positional relationship to each other.

In view of the problems described above, an object of the present invention is to provide an assembled component having an electrical connector and an electrical connector cap. In the present invention, it is possible to effectively prevent the electrical connector from shifting away from a regular position before the electrical connector is disposed onto a circuit board. A further object of the present invention is to provide an electrical connector cap and a method of mounting the electrical connector.

Further objects and advantages of the invention will be apparent from the following description of the invention.

SUMMARY OF THE INVENTION

In order to attain the objects described above, according to a first aspect of the present invention, an assembled component of electrical connectors and an electrical connector cap includes the plurality of electrical connectors to be disposed on a circuit board with a specific positional relationship to each other; and the electrical connector cap to join the plurality of electrical connector with the specific positional relationship to each other, and the electrical connector cap is to be attached to the plurality of connectors before disposing the connectors onto the circuit board.

In the assembled component of the electrical connectors and the electrical connector cap, the electrical connector cap includes a main body, which extends in two directions that are vertical to each other within one surface parallel to the circuit board upon disposing the plurality of connectors onto the circuit board, and a plurality of cap-side fitting section pairs, which fits to the respective electrical connectors at two positions in a direction vertical to the circuit board.

Each of the electrical connectors has a connector-side fitting pair, to which the cap-side fitting section pair fits. The plurality of cap-side fitting section pairs and the corresponding connector-side fitting section pairs have reference surfaces formed to set positions of the respective electrical connectors in concert with each other in the two directions, so that among all the connectors, the cap-side fitting section pairs and the connector-side fitting section pairs cooperate to maintain the specific positional relationship among the plurality of electrical connectors.

According to the present invention, the plurality of cap-side fitting sections and the connector-side fitting section pairs have the reference surfaces formed in two directions that are vertical to each other within one surface parallel to the circuit board. Once the electrical connector cap is attached to the plurality of electrical connectors, the reference surfaces of the cap-side fitting pairs and the corresponding reference surfaces of the connector-side fitting section pairs abut against each other in the two directions.

Therefore, in the respective electrical connectors, the cap-side fitting sections of each of the cap-side fitting pairs and the cap-side fitting sections of each of the cap-side fitting section pairs work in concert, so as to set the positions of the respective electrical connectors in the two directions. As a result, the specific positional relationship among the plurality of electrical connectors in the two directions is maintained. In addition, since the reference surfaces of the cap-side fitting section pairs and the connector-side fitting section pairs do not elastically displace, the connectors will not displace from the specific positional relationship.

When the electrical connectors are used, the connector-side fitting section pairs are preferably capable of fitting to the corresponding fitting section pairs of the mating connector in a direction vertical to the circuit board. More specifically, upon the use of the electrical connectors, the connector-side fitting section pairs to fit to the corresponding fitting section pairs of the mating connector are used also as fitting section pairs to fit to the cap-side fitting section pairs upon disposing the connector onto the circuit board before using the electrical connectors. Accordingly, it is not necessary to provide another fitting pairs to fit to the cap-side fitting section pairs in addition to the connector-side fitting section pairs to fit to the corresponding fitting section pairs of the mating connector, and it is possible to avoid increase of the connector size. In addition, since the electrical connectors have a simplified shape, it is possible to reduce a manufacturing cost thereof.

Preferably, the cap-side fitting section pairs and the connector-side fitting section pairs have one recess formed in the electrical connector housing or the cap main body, and one protrusion that is provided on the other and to be fitted to attach to the recess in a direction perpendicular to the circuit board. Moreover, it is preferred to form the reference surfaces on an inner wall surface of the recess and an outer wall surface of the protrusion.

The cap main body preferably has a plate surface that extends parallel to the circuit board. By forming the main body to have the plate surface as described above, the plate surface can be used as a suctioning surface to suction and transport the electrical connector to an implementation position using a suctioning member upon implementation of the electrical connector. Accordingly, it is easier to transport the assembled component of the connectors and the electrical connector cap.

According to the present invention, the electrical connector cap is attached to the plurality of electrical connectors, which is to be disposed on the circuit board with the specific positional relationship and joins the plurality of electrical connectors with the specific positional relationships, before the electrical connectors are arranged on the circuit board.

According to the present invention, the electrical connector cap includes the main body that extends in the two directions that are perpendicular to each other within one surface parallel to the circuit board upon disposing the plurality of electrical connectors to the circuit board; and the plurality of cap-side fitting section pairs to fit to the respective electrical connectors at two positions in the direction vertical to the circuit board.

The electrical connectors have the connector-side fitting section pairs to which the cap-side fitting section pairs fit, and the plurality of cap-side fitting section pairs and the corresponding connector-side fitting section pairs have the reference surfaces that cooperate to position the respective electrical connectors in the two directions. With the configuration of the electrical connector cap, the cap-side fitting section pairs and the connector-side fitting section pairs work in concert, and all the electrical connectors can be maintained in the specific positional relationships from each other.

According to the invention, a method of mounting the electrical connector includes the steps of mounting the plurality of electrical connectors on the circuit board with the specific positional relationships. According to the method, after attaching the electrical connector cap for joining the plurality of electrical connectors with the specific positional relationship to the plurality of electrical connectors, the plurality of electrical connectors are disposed and implemented thereon.

In the method of mounting the electrical connectors, according to the invention, the cap has the main body, which extends in two directions that are vertical to each other within the surface that is parallel to the circuit board upon disposing the plurality of electrical connectors onto the circuit board; and the plurality of cap-side fitting section pairs to fit the cap-side fitting section pairs.

Each of the electrical connectors has the connector-side fitting section pairs to fit to the cap-side fitting pair and the plurality of cap-side fitting pairs and the corresponding connector-side fitting section pairs cooperate to each other so as to form the reference surfaces to position the electrical connectors in the two directions. When the cap-side fitting section pairs are fitted to the corresponding connector fitting section pairs, the plurality of electrical connectors is disposed and implemented on the circuit board while maintaining the specific positional relationship among the plurality of electrical connectors by cooperation of the cap-side fitting section pairs and the connector-side fitting section pairs.

As described above, according to the present invention, the reference surfaces are formed on the cap-side fitting section pairs and the connector-side fitting section pairs in the two directions that are vertical to each other. Accordingly, each of the electrical connectors is positioned in the two directions by cooperation of the cap-side fitting sections of each pair and cooperation of the connector-side fitting sections of each pair. Therefore, it is possible to maintain the specific positional relationships in the two directions among the plurality of electrical connectors.

In addition, since the reference surfaces of the cap-side fitting section pairs and the connector-side fitting section pairs would not be elastically displaced, the electrical connectors will not be displaced and thereby it is possible to maintain the specific positional relationship thereof.

BRIEF DESCRIPTION OF THE DRAWINGS

FIGS. 4(A) and 4(B) are sectional views showing the electrical connectors and the electrical connector cap according to the first embodiment of the present invention, wherein FIG. 4(A) is a sectional view taken along a line IVA-IVA in FIG. 3 and FIG. 4(B) is a sectional view taken along a line IVB-IVB in FIG. 3;

DETAILED DESCRIPTION OF PREFERRED EMBODIMENTS

Hereunder, referring to the accompanying drawings, embodiments of the invention will be described.

<First Embodiment>

Figure 1:
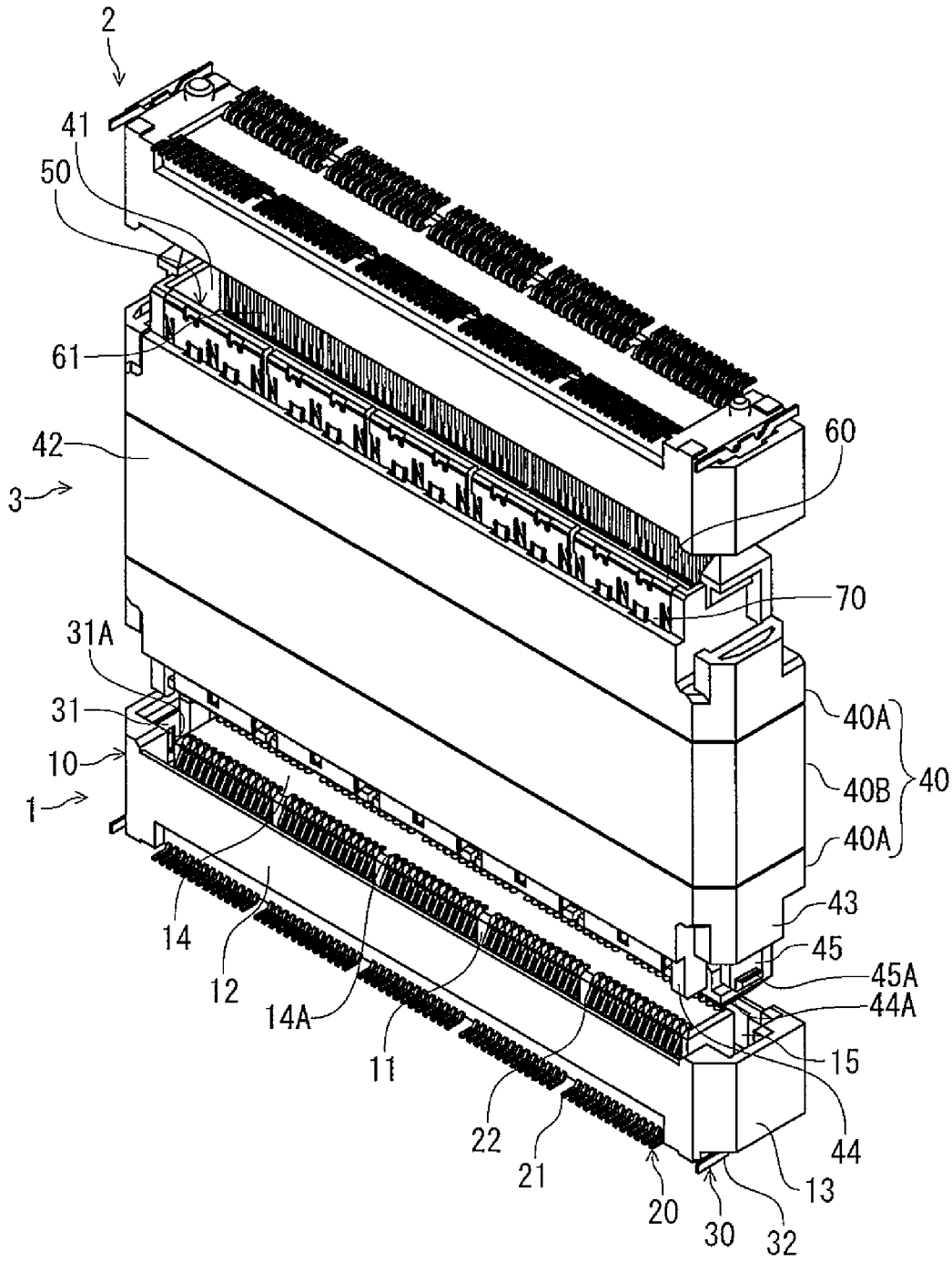
FIG. 1 is a perspective view showing an electrical connector in a state before the electrical connector is fitted to an intermediate connector and a mating connector according to a first embodiment of the present invention.

FIG. 1 is a total perspective view of a connector, which is to be connected to a mating connector via an intermediate connector, the intermediate connector, and the mating connector in a state before fitting to each other, according to this invention. In the embodiment, two circuit board electrical connectors 1 and 2 (hereunder, referred to as "connector 1" and "connector 2") have an identical shape to each other and are connectors to be respectively disposed onto corresponding circuit boards (not illustrated). The connector 1 and the connector 2 connect to each other via the intermediate connector 3.

More specifically, as shown in FIG. 1, the connector 1 is provided under the intermediate connector 3, and is connected to a lower end-side portion of the intermediate connector 3. On the other hand, the mating connector 2 is disposed above the intermediate connector 3, while being inversed in the up-and-down direction in relative to the connector 1, and fitted and connected to an upper end-side portion of the intermediate connector 3. Fitting and connecting the connector 1 and the mating connector 2, which are respectively disposed on the corresponding circuit boards, to the intermediate connector 3, those circuit boards are electrically connected to each other with their board surfaces extending parallel to each other.

As will be described later, according to the embodiment, a plurality of the connector 1 and the same number of the mating connectors 2 are disposed on respective circuit boards with specific positional relationships, and thereby the connectors 1 and their mating connectors 2 connect to each other via the intermediate connectors 3. Here, "the specific positional relationships" are set in advance according to requirements upon designing.

Figure 2:
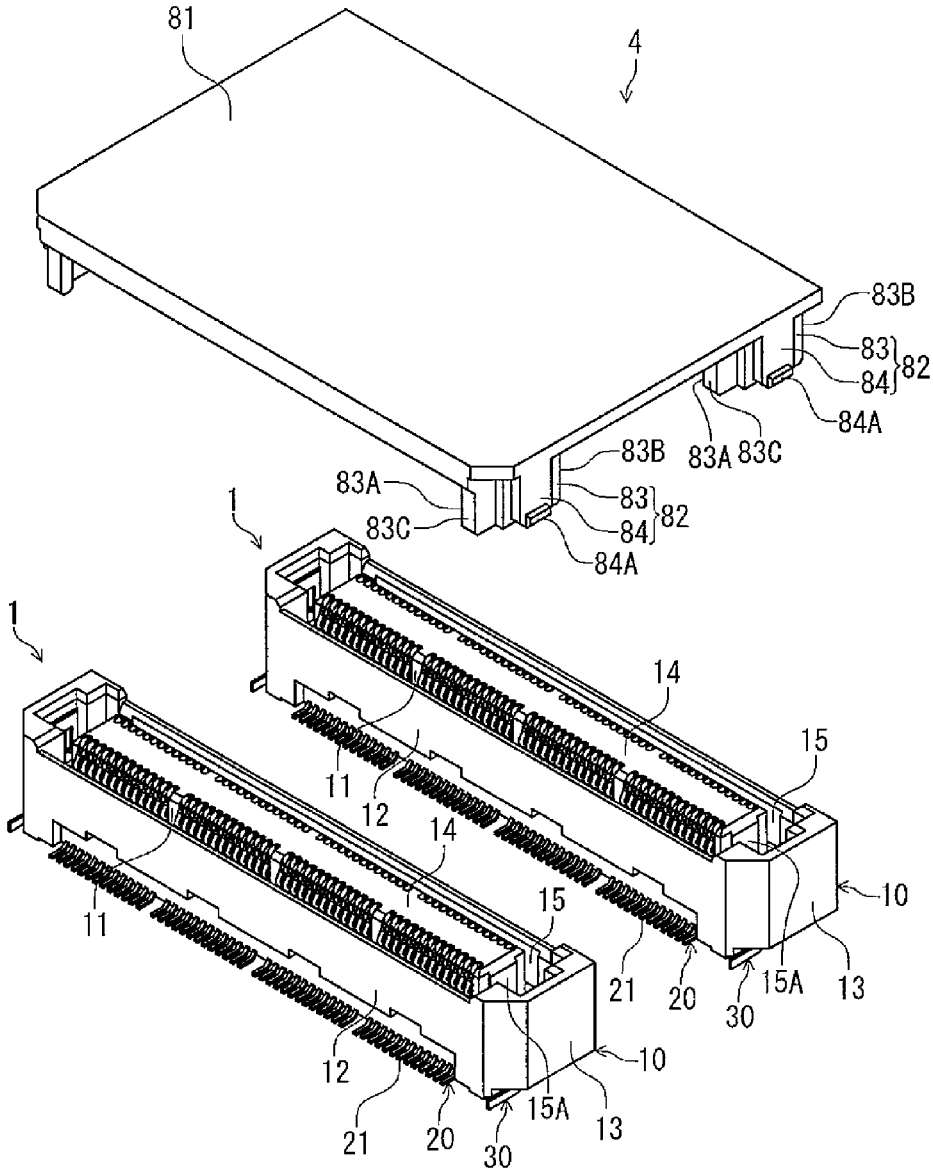
FIG. 2 is a perspective view showing an electrical connector cap and the electrical connectors in a state that the electrical connector cap is separated from the electrical connectors according to the first embodiment of the present invention.
Figure 3:
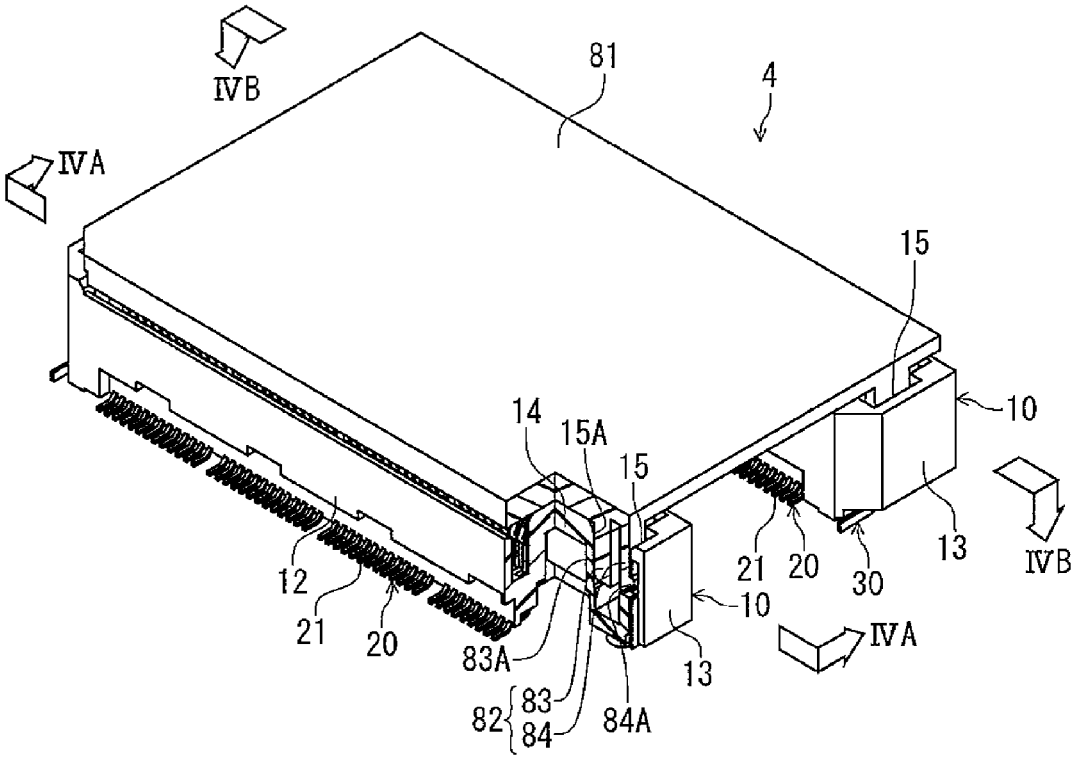
FIG. 3 is a perspective view showing the electrical connector cap and the electrical connectors in a state that the electrical connector cap is attached to the electrical connectors according to the first embodiment of the present invention.

Before disposing the plurality of connectors 1 on a circuit board, a cap 4 is attached thereto and thereby the connectors are joined by the cap while keeping the specified intervals from each other (See FIGS. 2 and 3). Then, the plurality of connectors 1 are conveyed with the caps 4 being attached thereto, and then disposed onto circuit boards while keeping the specified spacing from each other.

As shown in FIG. 1, the connector 1 has a housing 10 that has an outer shape of a generally rectangular prism and is made of synthetic resin; a plurality of metal terminals 20 that are to be arranged and held in the housing 10 along the longitudinal direction thereof, and metal fittings 30 to be held by the housing 10 at end sections of the housing 10 in the longitudinal direction.

The housing 10 has receiving space 11, which is opened upward to receive the intermediate connector 3. A circumferential wall that surrounds the receiving space 11 is formed by a pair of sidewalls 12 extending in the longitudinal direction of the housing 10, and a pair of end walls 13 that joins the both end sections of the pair of sidewalls 12 in the longitudinal direction.

Moreover, at a center part of the receiving space 11, there is provided an island-like center wall section 14 extending in the longitudinal direction of the housing 10, i.e., in the terminal arrangement direction. The receiving space 11 is annularly formed between the center wall section 14 and the circumferential wall of the housing 10 so as to surround the center wall section 14. On each sidewall surface of the center wall section 14, there are formed terminal housing grooves 14A at positions corresponding to the terminals 20 in the longitudinal direction so as to extend in the up-and-down direction (connector height direction).

As shown in FIG. 1, on the both end walls 13 of the housing 10, there are provided fitting recesses 15 as cap-side fitting sections being opened upward so as to form a part of the receiving space 11. Prior to disposing each connector 1 onto a circuit board, each fitting recess 15 receives a fitting protrusion 82 of the cap 4 to fit to the fitting protrusion 82. In addition, upon connector fitting, as will be described below, each fitting recess 15 serves as a guiding section to guide therein the flat wall section 44 of the end wall 43 of the intermediate connector 3 as will be described below, and thereby receives the flat wall section 44 and a hook section 45, which will be described below.

As described above, each fitting recess 15 is a part of the receiving space 11, and is formed by a U-shaped groove-like inner wall surface of the end wall 13 at each both end positions in the longitudinal direction of the housing 10 and a flat end surface wall of the center wall section 14. The inner wall surface of each end wall 13 is composed of two surfaces that face each other in the lateral direction of the housing 10 and a surface that faces the end wall surface of the center wall surface 14 in the longitudinal direction, and has a U-groove-like shape when viewed from thereabove.

Each end wall surface of the center wall section 14 extends vertically to the longitudinal direction and serves as a reference surface 15A to position the connector 1 in the longitudinal direction upon attaching the cap 4 to the connector 1 as will be described below (see FIGS. 2, 4(A), and 4(B).

In addition, among the inner wall surfaces of the end walls 13, two surfaces facing each other in the lateral direction extends vertically to the lateral direction and as will be described, upon attaching the cap 4 onto the connector 1, it serves as reference surfaces 15B and 15C to position the connector 1 in the lateral direction (See FIG. 4(B)).

As shown in FIG. 1, each terminal 20 has a generally L shape formed by bending a lower end side of a metal strip piece generally vertically to the sheet thickness direction. Being bent, the lower end section of the terminal 20 that extends in the lateral direction of the housing 10 extends sideward outside the housing 10 as a connecting section 21 to connect to a corresponding circuit section formed on the circuit board. Moreover, an upper section of each terminal 20 that extends upward is bent sideward so as to be convexly curved, and its convexly curved part protrudes into the receiving space 11 and is provided as a contact section 22 to contact with an intermediate terminal 61 of the intermediate connector 3, which will be described later.

Each terminal 20 is pressed from the contact section 22 side via a terminal insertion hole (not illustrated) formed on a bottom surface of the housing 10, and held in the terminal holding groove 14A of the central wall section 14. As shown in FIG. 1, each contact section 22 is provided to protrude in the receiving space 11, and as already described above, each connecting section 21 extends outward of the connector 1 in the lateral direction.

As shown in FIG. 1, the metal fittings 30 are provided on the both end walls 13 of the housing 10. Each metal fitting 30 is made of sheet metal, and has a flat sheet section 31 to be held by the housing 10, and a pair of legs 32 that extends from a lower end of the flat sheet section 31 in a direction to be away from each other in the lateral direction of the housing 10. Each metal fitting 30 is attached to the housing 10, by pressing side edge sections of the flat sheet section 31 in attachment section (not illustrated), which is formed on the both end walls 13 of the housing 10 and extends in the connector height direction (up-and-down direction), from therebelow.

One metal fitting 30 is provided for each end wall 13, and the pair of legs 32 extends from the lower end of the attachment hole and lower edges of the pair of legs 32 are connected by soldering to the circuit board and thereby the connector 1 is secured on the circuit board.

Furthermore, each flat sheet section 31 is held such that its plate surface faces the end wall surface (reference surface 15A) of the center wall section 14 of the housing 10 in the longitudinal direction. Each flat sheet section 31 has a hole formed therein, and the upper edge section that forms the hole serves as a latching section 31A to latch to the cap 4 or the intermediate connector 3.

Figure 4A:
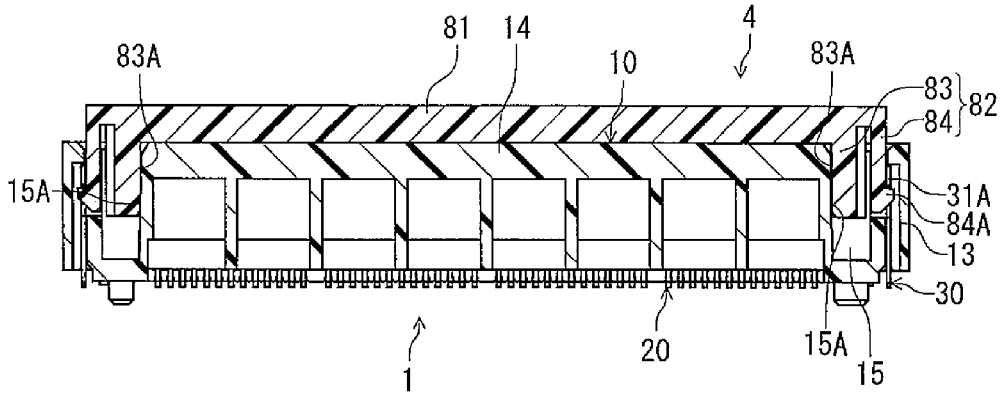

More specifically, upon attaching the cap 4 onto the connector 1, the latching section 31A latches onto a latching protrusion 81A of the cap 4 in the attachment direction (up-and-down direction) of the cap 4 (See FIGS. 3 and 4(A)). In addition, upon fitting the connector 1 to the intermediate connector 3, the latching section 31A latches to a latching claw 45A of the intermediate connector 3 in the connector fitting section (up-and-down direction).

Since the mating connector 2 has the same configuration as that of the connector 1, the explanation will be omitted.

As shown in FIG. 1, the intermediate connector 3 has a housing 40, which is made by joining synthetic resin tubular bodies 40A, 40B, and 40A in the up-and-down direction, and two flat sheet-like blade assemblies 50 that are to be held in the housing 40 facing to each other in the lateral direction of the housing 40. The housing 40 has an outer shape of a rectangular prism, and has a holding space 41 penetrating therethrough in the up-and-down direction to hold the blade assemblies 50. A circumferential wall that forms the holding space 41 is made by a pair of sidewalls 42 that extend in the longitudinal direction of the housing 40 and a pair of end walls 43 that join the ends of the pair of sidewalls 42 in the longitudinal direction.

Each end wall 43 of the housing 40 has its lower part dented in the longitudinal direction, in relative to an end surface of the intermediate portion in the up-and-down direction. Each end wall 43 has at the lower portion a flat wall section 44, a flat surface of which is vertical to the longitudinal direction; and a hook section 45 that extends parallel to the flat wall section 44 in the longitudinal direction at a position that is outer from the connector than the flat wall section 44 and away from the flat wall section 44 in the longitudinal direction and forms a cantilever-like flat section.

Each flat wall section 44 has a guiding surface 44A formed as a tapered surface on an outer surface at the lower end. Upon fitting the intermediate connector 3 to the connector 1, the guiding surface 44A abuts to an upper edge section of the fitting recess 15 of the connector 1, and thereby the flat wall section 44 is smoothly guided into the fitting recess.

The hook section 45 can elastically flexed and displaced towards the flat wall section 44 in the sheet thickness direction (in the aforementioned longitudinal direction), and has at its tip a latching claw 45A protruding outward of the connector 3 in the longitudinal direction. While the connector 1 and the intermediate connector 3 are being fitted to each other, the latching claw 45A of each hook section 45 latches to the latching section 31A of the metal fitting 30 of the connector 1 in the connector fitting direction, i.e. connector height direction (the up-and-down direction in FIG. 1), so that coming off of the connectors therefrom is prevented.

Except for not having a part corresponding to the hook section 45, since a shape of an upper part of the housing 40 is the same as that of a lower part of the housing 40, which has been described above, the explanation will be omitted.

As shown in FIG. 1, the two blade assemblies 50 are held within the holding space 41 of the housing 40 such that the plate surfaces face each other in the lateral direction of the intermediate connector 3. Each blade assembled component 50 has blades 60 that are formed by arranging on a flat circuit board surface a plurality of intermediate terminals 61 that extend parallel to each other, and has one grounding plate 70 that is attached thereto as a flat metal member and shared by the plurality of blades 60. As shown in FIG. 1, in each blade assembled component 50, the plurality of blades 60 is arranged having side edges adjacent to each other in the longitudinal direction of the intermediate connector 3 so as to be positioned on the same flat surface that extends vertically to the lateral direction, while the intermediate terminals 61 extends in the connector height direction. In other words, the plurality of intermediate terminals 61 is arranged in the longitudinal direction.

As shown in FIG. 1, while the housing 40 holds the blade assemblies 50, the lower part of each blade assembled component 50 protrudes lower than the lower edge of the housing 40. In a state that the connector 1 and the intermediate connector 3 are fitted to each other, the protruding lower part of each blade assembled component 50 enters the receiving space 11 of the connector 1, and each intermediate terminal 61 contacts with a contact section 22 of the terminal 20 of the connector 1. In addition, there is formed space between lower parts of the two blade assemblies 50 and the center wall section 14 of the connector 1 is configured to enter the space in the connector fitting state.

Since the form of the upper part of the intermediate connector 3 is symmetrical to the aforementioned lower part of the intermediate connector 3 in the up-and-down direction, the explanation will be omitted.

Next, a configuration of the cap 4 will be described. FIG. 2 is a total perspective view of the connector 1 and the cap 4, which are separated from each other, according to this embodiment. In the figure, two connectors 1 are shown with the cap 4. As shown in the figure, the two connectors 1 will be disposed to be parallel to each other at specific interval therebetween in the lateral direction of the connector 1 on a circuit board (not illustrated) using the cap 4.

As shown in FIG. 2, the cap 4 is made of synthetic resin, and has a quadrangle sheet-like main body 81, and a plurality of fitting protrusions 82, which extend downward from four corners of the main body 81 and serve as cap-side fitting sections. The main body 81 has a rectangular flat surface, and FIG. 2 is provided such that the longitudinal direction and the lateral direction of the main body 81 respectively correspond to those of the connectors 1. The main body 81 is made to have almost the same size as the connector 1 in the longitudinal direction, and is configured to cover most part of upper surfaces of the both connectors 1 in state of being attached to the two connectors 1 (see FIG. 3).

The fitting protrusions 82 are provided at positions corresponding to those of the pair of fitting recesses 15 provided at the both ends of each connector 1 in the longitudinal direction, and the two fitting protrusions 82 that correspond to each pair of the fitting recesses 15 are paired. More specifically, the cap 4 has two pairs of fitting protrusions 82. Each fitting protrusion 82 has a flat leg 83 that is provided on an inner side of the cap 4 in the longitudinal direction of the cap 4 than an edge sections that extend in the lateral direction of the cap 4 and has a surface vertical to the longitudinal direction; and a flat cantilever-like elastic piece 84 extending downward from the edge section and having a flat surface parallel to a plate surface of the flat leg 83.

Figure 4B:
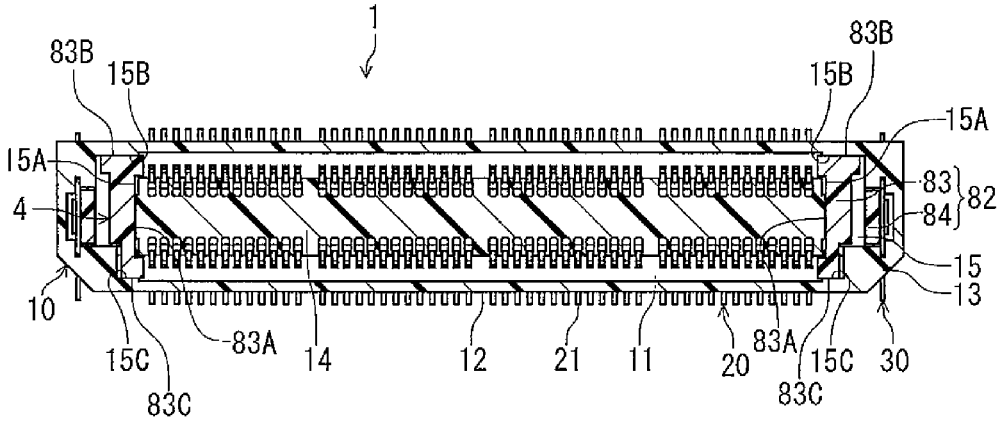

The flat legs 83 of the fitting protrusions 82 of each pair have their plate surfaces facing each other in the longitudinal direction of the cap 4 abut to the reference surfaces 15A of the fitting recesses 15 of the connector 1 and serve as reference surfaces 83A that position each connector 1 in the longitudinal direction (see also FIGS. 4(A) and 4(B)). In addition, two thick flat surfaces of each flat leg 83, which are vertical to the lateral direction of the connector 1, abut to the reference surfaces 15B and 15C of the connector 1 and serve as reference surfaces 83B and 83C to position each connector 1 in the lateral direction (see also FIG. 4(B)).

In each pair of fitting protrusions 82, the distance between the reference surfaces 83A of the pair of flat legs 83 in the longitudinal direction is almost equal to the distance between the pair of reference surfaces 15A of the connector 1 in the longitudinal direction, i.e. the dimension of the center wall section 14 in the longitudinal direction (see FIG. 4(B)). In addition, in each fitting protrusion 82, the distance between the reference surface 83B and the reference surface 83C in the lateral direction, i.e. the dimension of the flat leg 83 in the lateral direction is almost equal to the distance between the reference surface 15B and the reference surface 15C in the longitudinal direction of the connector 1 (see FIG. 4(B)).

Furthermore, as for the two pairs of fitting protrusions 82 of the cap 4, the distance between the reference surface 83B/83C of one pair of fitting protrusions 82 and the reference surfaces 83B/83C of the other pair of fitting protrusions 82 in the lateral direction is the same as the pre-set specified spacing between the connectors 1.

Each elastic piece 84 can be elastically flexed and displaced towards the flat leg 83 in its sheet thickness direction (the aforementioned longitudinal direction), and at a lower part of the plate surface provided a way from the flat leg 83, which is one of the two plate surfaces that are vertical to the longitudinal direction, there is formed a latching protrusion 84A that latches to the latching section 31A of the metal fitting 30 of the connector 1 in the up-and-down direction, in a state of the cap 4 attached to the connector 1.

Hereunder, referring to FIGS. 2 through 4, implementation of the two connectors 1 onto a circuit board will be described. FIG. 3 is a partial cutaway perspective view of the connector 1 and the cap 4 of FIG. 2, in which a part of the fitting portion of the fitting protrusion 82 and the fitting recess 15 is provided in a sectional view. In addition, FIG. 4 is a sectional view of the connector 1 and the cap 4 of FIG. 3, in which (A) is a IVA-IVA sectional view and FIG. 4(B) is a IVB-IVB sectional view. FIG. 4(A) is a cross-section of the connector 1 and the cap 4, which is taken in a direction vertical to the lateral direction of the connector 1, and FIG. 4(B) is a section of the connector 1 and the cap 4, which is taken in a direction vertical to the longitudinal direction of the connector 1.

First, as shown in FIG. 2, prior to attaching the cap 4, the two connectors 1 are disposed on a same flat surface with pre-set specified spacing therebetween in the lateral direction of the connector 1. Then, bringing the cap 4 over to above the two connectors 1, the cap 4 and the connectors 1 are aligned in the longitudinal direction and the lateral direction and each pair of fitting protrusions 82 are positioned to right above the fitting recesses 15 of the connector 1.

Next, moving the cap 4 downward, the pair of fitting protrusions 82 f the cap 4 is fitted in the pair of fitting recesses 15 of the corresponding one connector 1 from thereabove, and the other pair of fitting protrusions 82 of the cap 4 is fitted within the pair of fitting recesses 15 of the other connector 1 from thereabove. By the fitting between the fitting protrusions 82 and the fitting recesses 15, as shown in FIG. 3, the cap 4 is attached to the two connectors 1, and thereby the two connectors 1 are joined in the lateral direction. In the middle of fitting between the fitting protrusions 82 and the fitting recesses 15, the elastic piece 84 of each fitting protrusion 82 is pushed by the plate surface of the flat surface 31 of the metal fitting 30 and elastically displaces, and once it reaches the position of the hole of the flat section, it returns to its free state.

As a result, as shown in FIG. 4(A), the latching protrusion 84A of each elastic piece 84 and the latching section 31A of the flat section 31 are in the state of being able to latch in the inserting/removing direction (up-and-down direction) of the cap 4. By attaching the cap 4 to the connectors 1 as described above, the assembled component of the connectors 1 and the cap 4 is completed.

In the middle of fitting and in a state of fitting between the fitting protrusions 82 and the fitting recesses 15, the reference surfaces 83A of the pair of fitting protrusions 82 and the reference surfaces 15A of the pair of fitting recesses 15 respectively abut to each other in the longitudinal directions of the connectors 1, and each connector 1 is positioned in the longitudinal direction. More specifically, by cooperation of the pair of reference surfaces 83A and cooperation of the pair of the reference surfaces 15A, each connector 1 is positioned in the longitudinal direction and is brought to its regular position in the direction.

In addition, the reference surfaces 83B and 83C of the pair of fitting protrusions 82 and the reference surfaces 15B and 15C of the pair of fitting recesses 15 respectively abut to each other in the lateral directions of the connectors 1, and each connector 1 is positioned in the lateral direction. More specifically, by cooperation of the pair of reference surfaces 83B, cooperation of the reference surfaces 83C, cooperation of the pair of reference surfaces 15B and cooperation of the reference surfaces 15C, each connector 1 is positioned in the lateral direction and is brought to its regular position in the direction.

As described above, as a result that each connector 1 is positioned in the longitudinal direction and the lateral direction by the two types of reference surfaces that are vertical to each other, the two pairs of the fitting protrusions 82 of the cap 4 cooperate, the two pairs of the fitting recesses 15 of the two connectors 1 cooperate, and thereby it is possible to keep the specific positional relationship between the two connectors 1 in the longitudinal direction and the lateral direction.

The assembled component of the connectors 1 and the cap 4 is conveyed, having an upper surface of the main body 81 of the cap 4 be sucked by a suctioning device (not illustrated), and then is disposed at a specified position on a circuit board. Even upon conveying the assembled component and disposing it onto a circuit board, the two connectors 1 will not be displaced from the regular positions, so that the specific positional relationship between the two connectors 1 disposed on a circuit board is maintained.

Next, while keeping the cap 4 attached, the contact section 21 of each terminal 20 of each connector 1 and a corresponding circuit section (not illustrated) on a circuit board are connected by soldering to each other, and thereby implementation of the connectors 1 is completed. On the corresponding circuit section, there is a plurality of pads (not illustrate) formed at specified positions, which correspond to each connecting section 21 and is respectively connected by soldering to the connecting section 21. According to this embodiment, as described above, since the two connectors 1 are disposed keeping the specific positional relationship, it is possible to prevent displacement of the connecting sections 21 and the pads, and to secure connection by soldering at correct positions.

After completion of implementation of the connectors 1, the cap 4 is removed, and the connectors 1 are in a state of being ready to fit and connect with the intermediate connectors 3. According to this embodiment, since the specific positional relationship between the connectors 1 is maintained, it is possible to fit and connect the two mating connectors 2, which are disposed onto another circuit board in advance with specific positional relationship, to the respective corresponding connectors 1 via the intermediate connectors 3 at once. Furthermore, according to this embodiment, since each mating connector 2 has completely identical configuration to that of the connector 1, it is possible to position the mating connector 2 in a similar manner using the cap 4.

In this embodiment, since the main body 81 of the cap 4 is formed to have a generally flat board-like shape that extends in two directions, i.e. the longitudinal direction and the lateral direction of the main body 81, the distance between the fitting protrusions 82 in the aforementioned two directions, on which the reference surfaces 83A, 83B, and 83C for positioning the connectors 1 are formed, will not be changed. Therefore, it is possible to correctly position the connectors 1 in the above-described two directions using the reference surfaces 83A, 83B, and 83C of the cap 4. Moreover, since it is possible to use an upper surface of the main body 81 as a suctioning surface, it is possible to easily convey the assembled component of the cap 4 and the two connectors 1.

According to this embodiment, the fitting recesses 15 of each connector 1 are configured to be able to fit to both the flat wall sections 44 and the hook sections 45 of the end walls 43 of the intermediate connector 3 and the fitting protrusions 82 of and the cap 4. More specifically, upon using the connectors, the fitting recesses 15 serve as fitting sections to fit to the flat wall section 44 and the hook section 45 of the intermediate connector 3, and upon disposing the connectors onto a circuit board before using the connectors, they serve as fitting sections to fit to the fitting protrusions 82 of the cap 4.

Accordingly, since it is not necessary to separately provide fitting sections to fit to the fitting protrusions 82 of the cap 4 in addition to the fitting sections to fit to the flat wall sections 44 and the hook sections 45 of the intermediate connector 3, it is possible to prevent increase of the size of the connector 1. Moreover, since the shape of the connectors 1 is simplified, it is possible to reduce the manufacturing cost for that amount.

In addition, since the fitting recesses 15 of the connectors 1 are configured to be able to fit to the both flat wall section 44 and the hook sections 45 of the intermediate connector 3 and the fitting protrusions 82 of the cap 4, it is possible to make the space usually provided between the fitting recesses 15 and the flat wall sections 44 and the hook sections 45 for fitting therebetween and the space usually provided between the fitting recesses 15 and the fitting protrusions 82 for fitting therebetween are almost the same. Accordingly, since it is not necessary to consider the space for the intermediate connector 3 and the space for the cap 4 separately, it is easy to manage the dimension upon manufacturing and mounting the connector 1.

In this embodiment, a cap is attached to two connectors, but the number of connectors to attach the cap is not limited to this and can be 3 or more. In this case, the cap is provided with the same number of pairs of fitting protrusions as the number of connectors.

In this embodiment, a plurality of connectors is disposed in the lateral direction, but in this invention, the disposing direction of the connectors is not limited to this, and it is possible to dispose the connectors in any directions as long as the plurality of connectors is provided with specified spacing therebetween. For example, in a case of arranging the plurality of connectors in the longitudinal direction, it is also possible to apply the invention by forming the cap to have a shape so as to be able to attach to the plurality of connectors.

<Second Embodiment>

Since the cap has fitting recesses and the connector has fitting protrusions, this embodiment is different from the first embodiment, in which the cap has the fitting protrusions and the connector has the fitting recesses.

Figure 5:
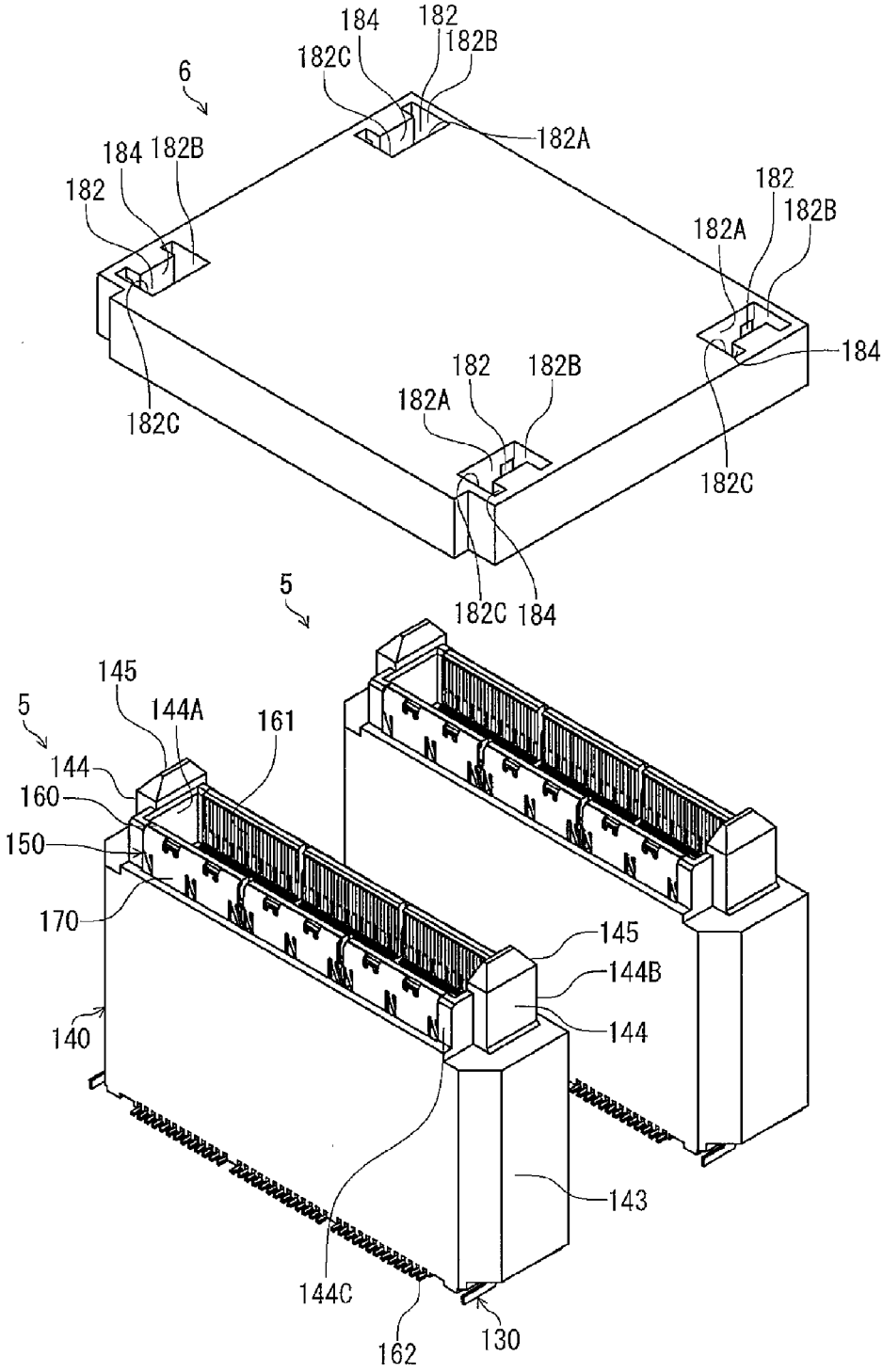
FIG. 5 is a perspective view showing an electrical connector cap and electrical connectors in a state that the electrical connector cap is separated from the electrical connectors according to a second embodiment of the present invention.
Figure 6:
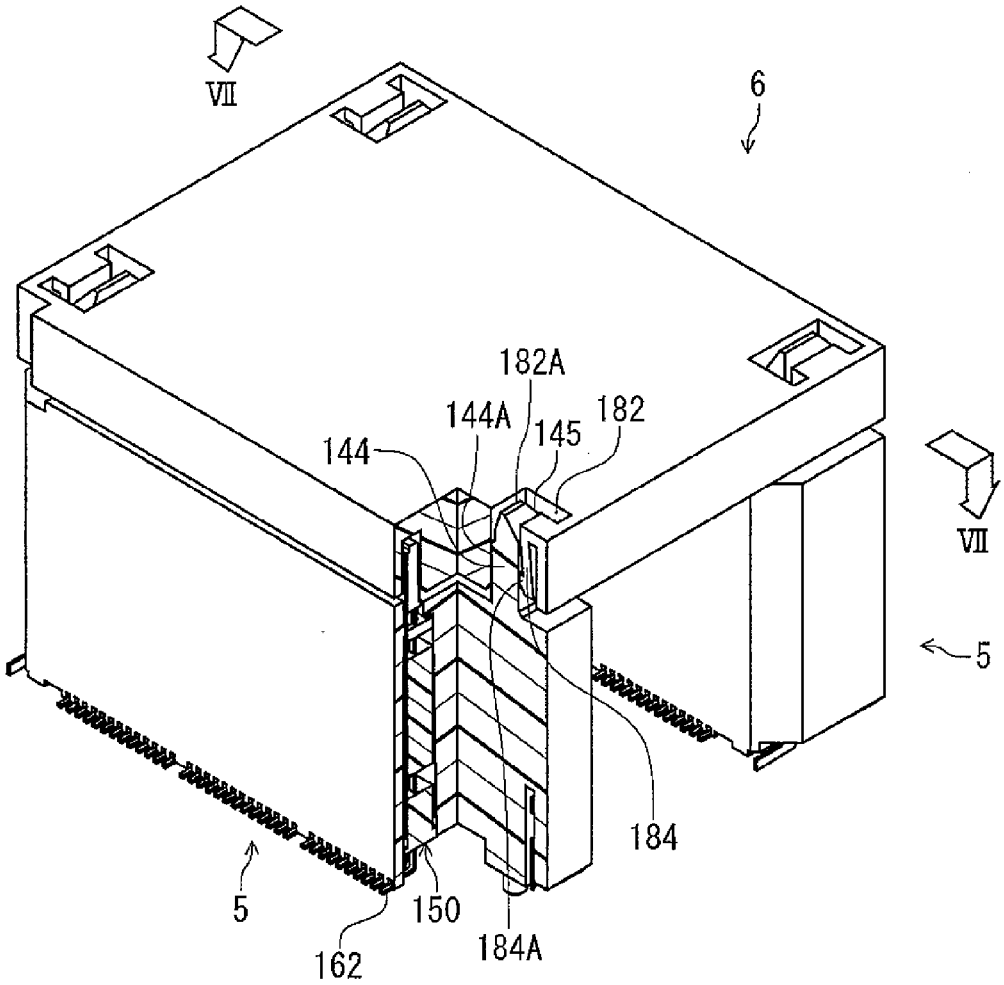
FIG. 6 is a perspective view showing the electrical connector cap and the electrical connectors in a state that the electrical connector cap is attached to the electrical connectors according to the second embodiment of the present invention.
Figure 7:
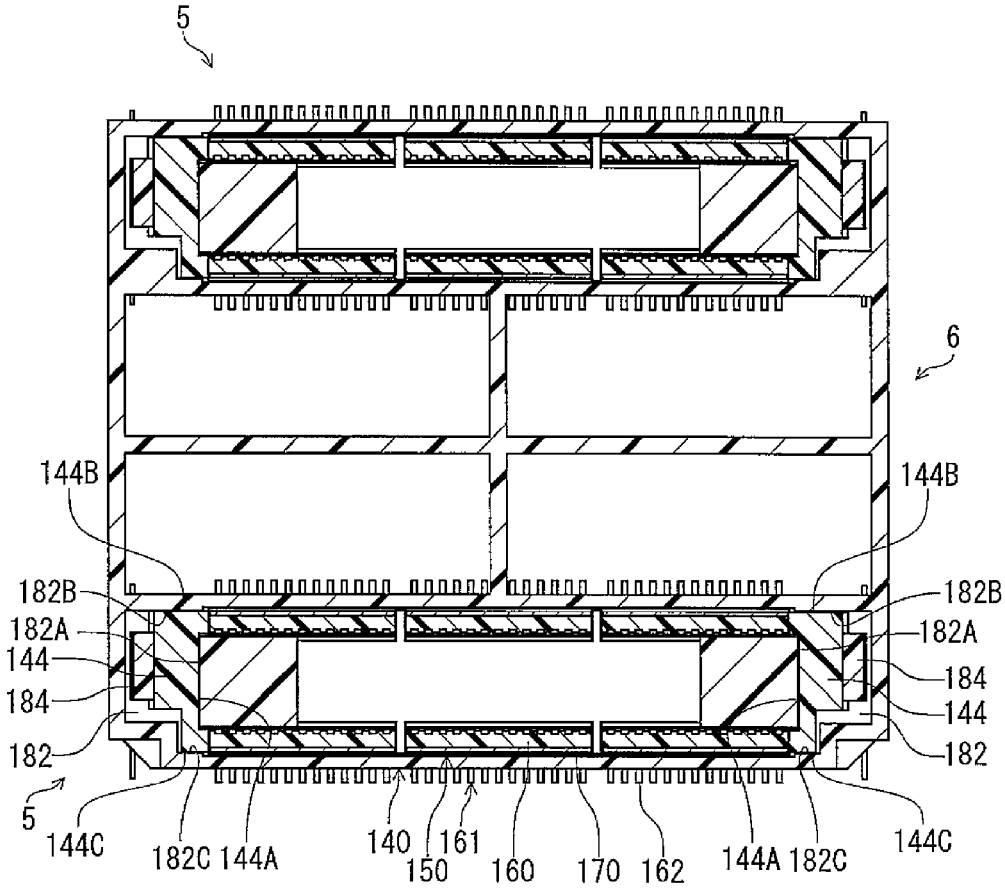
FIG. 7 is a sectional view of the electrical connectors and the electrical connector cap taken along a line VII-VII in FIG. 6 according to the second embodiment of the present invention.

FIG. 5 is a total perspective view of the plurality of connectors 5 and the cap 6, which are separated from each other. FIG. 6 is a total perspective view showing a fitting state between the connectors 5 and the cap 6 of FIG. 5. In FIG. 6, a part of the fitting protrusion 144 of the connector 5 and a part of the fitting recess 182 of the cap 6 are shown in a sectional view. In addition, FIG. 7 is a VII-VII sectional view of the connectors 5 and the cap 6 of FIG. 6, and shows a lateral sectional view taken at a fitting position of the fitting protrusions 144 and the fitting recesses 182 in the up-and-down direction.

As shown in FIGS. 5 and 6, the connector 5 of this embodiment is a connector to be implemented on a circuit board like the connector 1 of the first embodiment, and holds blade assemblies as the intermediate connector 3 of the first embodiment and fit to the mating connector (not illustrated) in the up-and-down direction. Each connector 5 has a tubular housing 140 made of synthetic resin; two flat blade assemblies 150 to be held by the housing 140 while facing to each other in the lateral direction of the housing 140; and securing metal fittings 130 to be held in the housing 140 at the both ends of the housing 140 in the longitudinal direction of the connector 5.

Each end wall 143 of the housing 140 is dented in the longitudinal direction of the connector 5 in relative to the end surface of the other part in the up-and-down direction. An upper part of each end wall 143 has a fitting protrusion 144 that has a flat surface vertical to the longitudinal direction and serves as a connector-side fitting section.

Each fitting protrusion 144 is configured to have a larger thickness, i.e. a larger dimension in the longitudinal direction, in part in the lateral direction of the connector 5 in comparison with other part, and the portion having larger thickness has a tapered guiding section 145 that protrudes upward than the upper end of the blade assembled component 150. The guiding section 145 has a pair of guiding surfaces that tilt in the longitudinal direction and a pair of guiding inner surfaces that tilt in the lateral direction. By abutting the guiding surfaces to the lower edge of the fitting recess 182 of the cap 6, which will be described later, the fitting protrusion 144 can be smoothly guided to enter the fitting recess 182.

In the fitting protrusions 144 respectively provided at both ends of the connector 5 in the longitudinal direction, the flat surfaces facing in the longitudinal direction serve as reference surfaces 144A to position the connector 5 in the longitudinal direction upon attaching the cap 6 to the connector 5.

Furthermore, as will be described later, in each fitting protrusion 144, the two thick surfaces that are vertical to the lateral direction of the connector 5 serve as reference surfaces 144B and 144C to position the connector 5 in the lateral direction upon attaching the cap 6 to the connector 5 (see FIG. 7). The reference surfaces 144B and 144C are provided at the same positions as the plate surfaces of the grounding plates 170 of the blade assemblies 150 (see also FIG. 7).

As shown in FIGS. 5 and 6, except that its connecting section 162 of each terminal 161 extends at a lower part outside the housing 140 in the lateral direction and can be connected by soldering to a corresponding circuit section of a circuit board, each blade assembled component 150 has the same configuration as that of the blade assembled component 50 of the first embodiment. In addition, each securing metal fitting 130 has the same configuration as the securing metal fitting 30 of the first embodiment.

As shown in FIG. 5, the cap 6 made of synthetic resin has a quadrangle flat main body and the figure is provided aligning the longitudinal direction and the lateral direction thereof to the longitudinal directions and the lateral directions of the connectors 5, respectively. At four corner positions of the cap 6, there are formed a plurality of fitting recesses 182, which serve as cap-side fitting sections, as holes penetrating in the up-and-down direction. Each fitting recess 182 is provided at a position corresponding to the pair of fitting protrusions 144 positioned at the both ends of each connector 5 in the longitudinal direction, and two fitting recesses 182 corresponding to each pair of fitting protrusions 144 are respectively paired. In other words, the cap 6 has two pairs of fitting recesses 182.

Each fitting recess 182 has a quadrangle cross-section that is parallel to the plate surface of the cap 6, and an inner wall surface of the fitting recess 182 is composed of two surfaces that face each other in the longitudinal direction and two surfaces facing each other in the lateral direction. As well shown in FIG. 6, within each fitting recess 182, there is formed an elastic piece 184 that is joined to an upper part of the surface provided outer side of the cap in the longitudinal direction, which is one of the two surfaces facing in the longitudinal direction, and extends downward. The elastic piece 184 is formed like a flat cantilever that has a plate surface parallel to the surface and can be elastically flexed in the sheet thickness direction.

As shown in FIG. 5, in the inner wall surfaces of the fitting recesses 182 of each pair, surfaces facing in the longitudinal direction to surfaces provided with the elastic piece 184 abut to reference surfaces 144A of the fitting protrusions 144 of the connector 5 and serve as reference surfaces 182A that position each connector 5 in the longitudinal direction (see also FIG. 7). In addition, in the inner wall surfaces of each pair of fitting recesses 182, two surfaces facing in the lateral direction abut to the reference surfaces 144B and 144C of the connector 5 and serve as reference surfaces 182B and 182C that position each connector 5 in the lateral direction (see also FIG. 7).

As seen in FIG. 7, in each pair of fitting recesses 182, the distance between the pair of reference surfaces 182A in the longitudinal direction is almost the same as the distance between the pair of reference surfaces 144A in the longitudinal direction of the connector 5. In addition, the distance between the reference surface 182B and the reference surface 182C in the lateral direction in each fitting recess 182, i.e. a dimension of the fitting recess 182 in the lateral direction, is almost the same as the distance between the reference surface 144B and the reference surface 144C in the lateral direction.

In addition, in two pairs of fitting recesses 182 of the cap 6, the distance in the lateral direction of the cap 6 between the reference surfaces 182B and 182C of one pair of fitting recesses 182 and the reference surfaces 182B and 182C of the other pair of fitting recesses 182 is set to the same as the pre-set specified spacing between the connectors 5.

As shown in FIG. 6, each elastic piece 184 is configured to be elastically flexed and displaced so as to be away from the reference surface 182A in the sheet thickness direction (the longitudinal direction), and a lower part of the plate surface provided on the side of the reference surface 182A side, which is one of the two surfaces vertical to the longitudinal direction, has a pressing protrusion 184 formed to press the fitting protrusion 144 of the connector 5 while the cap 6 is being attached to the connector 5.

Hereunder, referring to FIGS. 5 through 7, implementation of the two connectors 5 onto a circuit board will be described. Similarly to the first embodiment, first, as shown in FIG. 5, before attaching the cap 6, the cap 6 is brought over to above the two connectors 5 disposed on one flat surface with pre-set specified spacing. Then, moving the cap 6 downward, the pair of fitting protrusions 144 of each connector 5 is fitted in the corresponding pair of fitting recesses 182 of the cap 6 from therebelow. As a result, as shown in FIG. 6, the cap 6 is attached to the two connectors 5, and the two connectors 5 are joined in the lateral direction. Attaching the cap 6 to the connectors 5 as described above, the assembled component of the connectors 5 and the cap 6 is completed.

In the middle of fitting between the fitting protrusions 144 and the fitting recesses 182, the elastic piece 184 provided within the fitting recess 182 is pushed by the plate surface of the fitting protrusion 144 to elastically displace, and by the reaction force, the pressing protrusion 184A presses the plate surface of the fitting protrusion 144. As a result, by tightly pressing each fitting protrusion 144 with the reference surface 182A of the fitting recess 182 and the elastic piece 184 of the cap 6 in the longitudinal direction of the connector 5, it is possible to prevent unexpected coming off of the cap 6.

Even in this embodiment, the form of positioning of each connector 5 in the longitudinal direction and the lateral direction of the connector in the middle of fitting between the fitting protrusions 144 and the fitting recesses 182 and in their fitting state is similar to that of the first embodiment. In other words, as shown in FIG. 7, by abutting the reference surfaces 144A of the pair of fitting protrusions 144 to the reference surfaces 182A of the pair of fitting recesses 182 in the longitudinal direction and abutting the reference surfaces 144B and 144C of the pair of fitting protrusions 144 to the reference surfaces 182B and 182C of the pair of fitting recesses 182 in the lateral direction, the connector 5 is positioned in the longitudinal direction and the lateral direction.

As described above, even in this embodiment, by cooperation of the pair of reference surfaces 144A, 144B, 144C, 182A, 182B, and 182C respectively, the connector is brought to regular position in the longitudinal direction and the lateral direction.

As described above, as a result of positioning each connector 5 in the longitudinal direction and the lateral direction by the two types of reference surfaces that are vertical to each other, the two pairs of the fitting recesses 182 of the cap 6 cooperate and the two pairs of the fitting protrusions 144 of the two connectors 5 cooperate, and thereby the specific positional relationship between the two connectors 5 can be maintained in the longitudinal direction and the lateral direction.

Similarly to the first embodiment, the connectors 5 are connected by soldering and implemented onto a corresponding circuit section on a circuit board while the cap 6 is being attached, and after completion of the implementation, the cap 6 will be removed and the connectors 5 are ready to fit to their mating connectors (not illustrated).

In addition, if the mating connector is provided with fitting recesses, each of which has the same shape as that of the fitting recess of the cap 6 so as to be able to fit to the fitting protrusion 144 of the connector 5, it is possible to prevent increase of the size of the connector 5 and reduce the manufacturing cost similarly to the first embodiment.

The disclosure of Japanese Patent Application No. 2010-193319, filed on Aug. 31, 2010 is incorporated in the application by reference.

While the invention has been explained with reference to the specific embodiments of the invention, the explanation is illustrative and the invention is limited only by the appended claims.

What is claimed is:

1. An assembled component, comprising:

a plurality of electrical connectors to be disposed on a circuit board in a specific positional arrangement, each of said electrical connectors including a plurality of terminals arranged along a first direction; and an electrical connector cap attached to the electrical connectors for joining the electrical connectors before the electrical connectors are disposed onto the circuit board, wherein said electrical connector cap includes a main body extending in the first direction and a second direction perpendicular to the first direction on a plane parallel to the circuit board and a first fitting section including a first reference surface, said electrical connector cap further includes a latching section formed on the first fitting section on a surface thereof opposite to the first reference surface, and each of said electrical connector includes a second fitting section at an end portion thereof in the first direction for engaging the first fitting section, said second fitting section including a second reference surface for contacting with the first reference surface so that the electrical connectors are arranged in the specific positional arrangement.

2. The assembled component according to claim 1, wherein said first fitting section is arranged to engage the second fitting section at two positions in a third direction perpendicular to the circuit board.

3. The assembled component according to claim 1, wherein said first fitting section is arranged to engage a fitting section of the mating connector in a third direction perpendicular to the circuit board.

4. The assembled component according to claim 1, wherein one of said first fitting section and said second fitting section is formed of a recess portion, and the other of said first fitting section and said second fitting section is formed of a protruding portion for engaging the recess portion in a third direction perpendicular to the circuit board.

5. The assembled component according to claim 1, wherein said main body includes a plate surface extending in parallel to the circuit board.

6. The assembled component according to claim 1, wherein said second fitting section including the second reference surface extending in the second direction for contacting with the first reference surface so that the electrical connectors are arranged in the specific positional arrangement in the first direction.

7. An electrical connector cap to be attached to a plurality of electrical connectors each having a plurality of terminals arranged along a first direction for joining the electrical connectors in a specific positional arrangement, comprising:

a main body extending in the first direction and a second direction perpendicular to the first direction on a plane parallel to the circuit board;

a first fitting section for engaging a second fitting section formed on an end portion of each of the electrical connectors in the first direction, said first fitting section including a first reference surface for contacting with a second reference surface formed on the second fitting section so that the electrical connectors are arranged in the specific positional arrangement; and a latching section formed on the first fitting section on a surface thereof opposite to the first reference surface.

8. A method of mounting a plurality of electrical connectors each having a plurality of terminals arranged along a first direction on a circuit board, comprising the steps of:

attaching an electrical connector cap to the electrical connectors so that a first fitting section formed on the electrical connector cap engages with a second fitting section formed on an end portion of each of the electrical connectors in the first direction, a first reference surface formed on the first fitting section contacts with a second reference surface formed on the second fitting section to join the electrical connectors in a specific positional arrangement, and a latching section formed on the first fitting section on a surface thereof opposite to the first reference surface engages with each of the electrical connectors; and mounting the electrical connectors with the electrical connector cap attached thereto on the circuit board in the specific positional arrangement.

* * * * *